US007209144B2

(12) United States Patent
Kurumisawa

(10) Patent No.: US 7,209,144 B2
(45) Date of Patent: Apr. 24, 2007

(54) IMAGE-DISPLAY APPARATUS, IMAGE-DISPLAY METHOD, AND IMAGE-DISPLAY PROGRAM

(75) Inventor: Takashi Kurumisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 293 days.

(21) Appl. No.: 10/910,462

(22) Filed: Aug. 4, 2004

(65) Prior Publication Data

US 2005/0068344 A1 Mar. 31, 2005

(30) Foreign Application Priority Data

Sep. 10, 2003 (JP) ..... 2003-318448

(51) Int. Cl.
*G09G 5/00* (2006.01)

(52) U.S. Cl. ..... 345/596; 345/597; 345/598; 345/599; 345/589

(58) Field of Classification Search ..... 345/596–600, 345/606

See application file for complete search history.

(56) References Cited

U.S. PATENT DOCUMENTS 4,796,094 A * 1/1989 van Dorsselaer ..... 358/3.2
4,903,123 A * 2/1990 Kawamura et al. ..... 358/533
4,992,955 A * 2/1991 Yabuuchi et al. ..... 345/428
7,030,846 B2 * 4/2006 Lee et al. ..... 345/89
2002/0070948 A1 * 6/2002 Murai et al. ..... 345/589
2002/0080377 A1 * 6/2002 Tonami et al. ..... 358/1.9
2003/0035146 A1 * 2/2003 Yu et al. ..... 358/3.14

FOREIGN PATENT DOCUMENTS

JP A 10-63242 3/1998
JP A 2002-366103 12/2002

* cited by examiner

*Primary Examiner*—Ulka Chauhan
*Assistant Examiner*—Eric Woods
(74) *Attorney, Agent, or Firm*—Oliff & Berridge, PLC

(57) ABSTRACT

Aspects of the invention provide an image-display apparatus including an image display, such as a liquid-crystal display panel, where the image display can display a limited number of gray scales, interpolation is performed so that the number of gray scales displayed by the image display becomes the same as that of gray scales of obtained image data. The image-display apparatus can have the liquid-crystal display panel or the like and can be mounted on a mobile phone, a PDA, and so forth, so as to process and display image data transmitted from outside sources. First, a CPU performs a bit-slice process for the obtained image data, so as to reduce the data amount thereof. Next, a dither processing unit performs a dither process for interpolating the reduced data amount, so as to represent half-tone gray scales simulatively. In the invention, the dither process can be performed by using a 3×3 dither matrix for data whose gray-scale value corresponds to a predetermined area and a 2×2 dither matrix for data whose gray-scale value does not correspond to the predetermined area. Subsequently, the image display can display a predetermined image, where the number of gray scales of the predetermined image is the same as that of gray scales of the obtained data.

7 Claims, 12 Drawing Sheets

Table 1

| | |
|---|---|
| 0 | 3, (5) |
| 5 | 1, (3) |

↑

WHERE INPUTTED GRAY–SCALE VALUE IS
THE SAME AS NUMBER IN PARENTHESES,
IT IS CONVERTED TO N+2–LEVEL GRAY SCALE

FIG. 11A

Table 2

| | |
|---|---|
| 6 | (8), 9 |
| 10 | 7 |

↑

WHERE INPUTTED GRAY-SCALE VALUE IS
THE SAME AS NUMBER IN PARENTHESES,
IT IS CONVERTED TO N–LEVEL GRAY SCALE

FIG. 11B

IMAGE-DISPLAY APPARATUS, IMAGE-DISPLAY METHOD, AND IMAGE-DISPLAY PROGRAM

BACKGROUND OF THE INVENTION

1. Field of Invention

Aspects of the invention relate to a method for displaying a predetermined number of gray scales that are the same as those of obtained image data on an image display, such as a liquid-crystal-display panel provided in an image display apparatus, where the image display can display a limited number of gray scales.

2. Description of Related Art

A related art lightweight and low-profile display device, such as an LCD (liquid crystal display), can be mounted on a mobile terminal device, such as a mobile phone, a PDA (personal digital assistant), and so forth. Though full-color image data (eight bits for each of colors R, G, and B per each pixel (256 gray scales)) can be inputted for displaying an image on the above-described display device, the display often has to display gray scales of six bits for each of the colors R, G, and B (64 gray scales), for example, due to its limited performance. In this case, therefore, though the number of colors of the inputted image data is 16,777,216 in total (=256×256×256), the sum of displayed colors becomes 262,144 (=64×64×64).

In general, therefore, a method for interpolating the above-described shortage of colors simulatively by representing half-tone gray scales by a plurality of pixels through a dither process, an error-diffusion process, and so forth, is used frequently. For increasing the 64 gray scales to the 256 gray scales, for example, the dither process is performed, so as to interpolate three gray scales between steps of the 64 gray scales. However, since the number of gaps between the steps of the 64 gray scales (six bits) is 63, the number of gray scales obtained by the interpolation is only 253 (64+63×3). This gray-scale number does not agree with 256 perfectly and is three short of the required number. Subsequently, the number of colors becomes 16,194,277 (=253×253×253), which is 582,939 short of the total required number, when compared to that of the original data. Where the display apparatus can represent only five bits (32 gray scales) due to its performance, the gray-scale number becomes 249 (32+31×7), even though the above-described dither process is performed. Subsequently, the gray-scale number becomes seven short of the required number. Therefore, 1,338,967 colors are lost in total. Thus, where only one type of dither process is performed for the entire gray scales, so as to interpolate gray scales therebetween, the number of obtained colors does not perfectly agree with the number of colors of the original full-color image data.

SUMMARY OF THE INVENTION

Aspects of the invention can provide an image-display apparatus including an image display such as a liquid-crystal-display panel, where the image display can display a limited number of gray scales, an image display method, and an image-display program. The image-display apparatus can interpolate a predetermined number of colors for displaying a predetermined number of gray scales that are the same as those of obtained image data on the image display.

According to an aspect of the invention, an image-display apparatus having an image display can include an image display that can display n-bit gray scales, an image-data obtain device for obtaining m-bit image data to be displayed, bit-number decrease means for decreasing the number of bits of the image data from m to n, an interpolation device for interpolating a predetermined number of gray scales for the n-bit image data by performing a dither process and generating interpolation image data having a predetermined number of gray scales corresponding to the m bits, and display control device for displaying the interpolation image data on the image display.

The above-described image-display apparatus can be various types of terminal devices including a mobile phone, a mobile terminal, and so forth, which have a liquid-crystal-display panel, as the image display. The liquid-crystal-display panel is often not able to display inputted m-bit data such as full-color data of eight bits for each color due to its performance. Therefore, image data with reduced data amount is displayed on the image display. At this time, according to the invention, the dither process is performed for interpolating the half tone simulatively, so as to display a predetermined number of gray scales that are the same as those of the obtained image data. Subsequently, it becomes possible to display an image having a predetermined number of gray scales that are the same as those of a full-color image without deviating from an original image.

According to a mode of the above-described image-display apparatus, the interpolation device can perform the dither process by using a second dither matrix, where a gray-scale value of the m-bit image data corresponds to a predetermined area, and performs the dither process by using a first dither matrix, where the gray-scale value does not correspond to the predetermined area. It becomes possible to make the gray-scale number of a displayed image coincide with that of the inputted image data by switching between the dither process using the first dither matrix and the dither process using the second dither matrix according to the gray-scale number.

According to another mode of the above-described image-display apparatus, the first dither matrix is a 2×2-pixel matrix and the second dither matrix is a 3×3-pixel matrix. Where the gray-scale number does not correspond to the predetermined area, the dither process is performed by using the 2×2 dither matrix. Where the gray-scale number corresponds to the predetermined area, the dither process is performed by using the 3×3 dither matrix. Where the 2×2 dither matrix is used, the gray-scale number can be increased by as much as only three gray scales. However, where the 3×3 dither matrix is used, the gray-scale number can be increased by as much as eight gray scales at the maximum. Therefore, the 3×3 dither matrix is used for the gray-scale value corresponding to the predetermined area, so as to increase the gray-scale number. Subsequently, it becomes possible to make an inputted gray-scale number coincide with the gray-scale number of a displayed image.

According to another mode of the above-described image-display apparatus, the interpolation device can perform the dither process by using the second dither matrix only for image data having a predetermined gray-scale value of the m-bit image data. Therefore, as for image data other than the image data having the predetermined gray-scale value, it becomes possible to make the inputted gray-scale number coincide with that of a displayed image without changing the pixel size of the dither matrix used for the dither process. For example, for image data having a predetermined number of gray scales, the dither process can be performed by using a dither matrix including a predetermined number of gray scales corresponding to three steps. Subsequently, it becomes possible to make the gray-scale number of the displayed image coincide with that of the inputted image.

According to another mode of the above-described image-display apparatus, the bit-number decrease device can use high-order n bits of the m-bit image data, as the n-bit image data. The bit-number decrease means performs bit-slice for several low-order bits of an inputted image data, for example. Subsequently, the data amount is adjusted so that the data can be displayed on the image display.

According to an exemplary embodiment, the m bits are eight bits, the n bits are six bits, and the number of gray scales corresponding to the m bits is 256. The above-described process is performed for inputted full-color image data of eight bits for each color, so as to display image data of six bits for each color.

Further, according to another exemplary embodiment, the interpolation device increases the image data by as much as 186 gray scales by performing the dither process using the first dither matrix and increases the image data by as much as 6 gray scales by performing the dither process using the second dither matrix. Where an inputted image has the 256 gray scales, first, the bit-number decrease means decreases the gray-scale number to 64. Of the shortage of 192 (256–64) gray scales, 186 gray scales are interpolated by using the first dither matrix and the remaining six gray scales are interpolated by using the second dither matrix.

According to a similar aspect of the invention, there is provided an image-display method performed by an image-display apparatus comprising an image display that can display n-bit gray scales. The image-display method can include an image-data obtaining step for obtaining m-bit image data to be displayed, a bit-number decreasing step for decreasing the number of bits of the image data from m to n, an interpolation step for interpolating a predetermined number of gray scales for the n-bit image data by performing a dither process and generating interpolation image data having a predetermined number of gray scales corresponding to the m bits, and a display control step for displaying the interpolation image data on the image display.

According to another similar aspect of the invention, there can be provided an image-display program executed by an image-display apparatus comprising an image processing unit and an image display that can display n-bit gray scales. The executed image-display program makes the image-display apparatus function as an image-data obtain device for obtaining m-bit image data to be displayed, a bit-number decrease device for decreasing the number of bits of the image data from m to n, an interpolation device for interpolating a predetermined number of gray scales for the n-bit image data by performing a dither process and generating interpolation image data having a predetermined number of gray scales corresponding to the m bits, and a display control device for displaying the interpolation image data on the image display.

Accordingly, it becomes possible to perform interpolation for displaying a predetermined number of gray scales that are the same as those of obtained image data on an image display that can display a limited number of gray scales by using the above-described image-display method and image-display program, as is the case with the above-described image-display apparatus.

BRIEF DESCRIPTION OF THE DRAWINGS

The invention will be described with reference to the accompanying drawings, wherein like elements reference like numerals, and wherein:

FIG. 5 illustrates an interpolation method performed through a dither process according to an exemplary embodiment 1a ;

FIG. 7 shows a flowchart relating to the embodiment 1a;

FIG. 10 shows a flowchart relating to an exemplary embodiment 2a;

FIGS. 11(*a*) and 11(*b*) illustrate dither matrixes used for an exemplary embodiment 2b.

DETAILED DESCRIPTION OF PREFERRED EMBODIMENTS

Embodiments of the invention will now be described with reference to the attached drawings.

Figure 1:
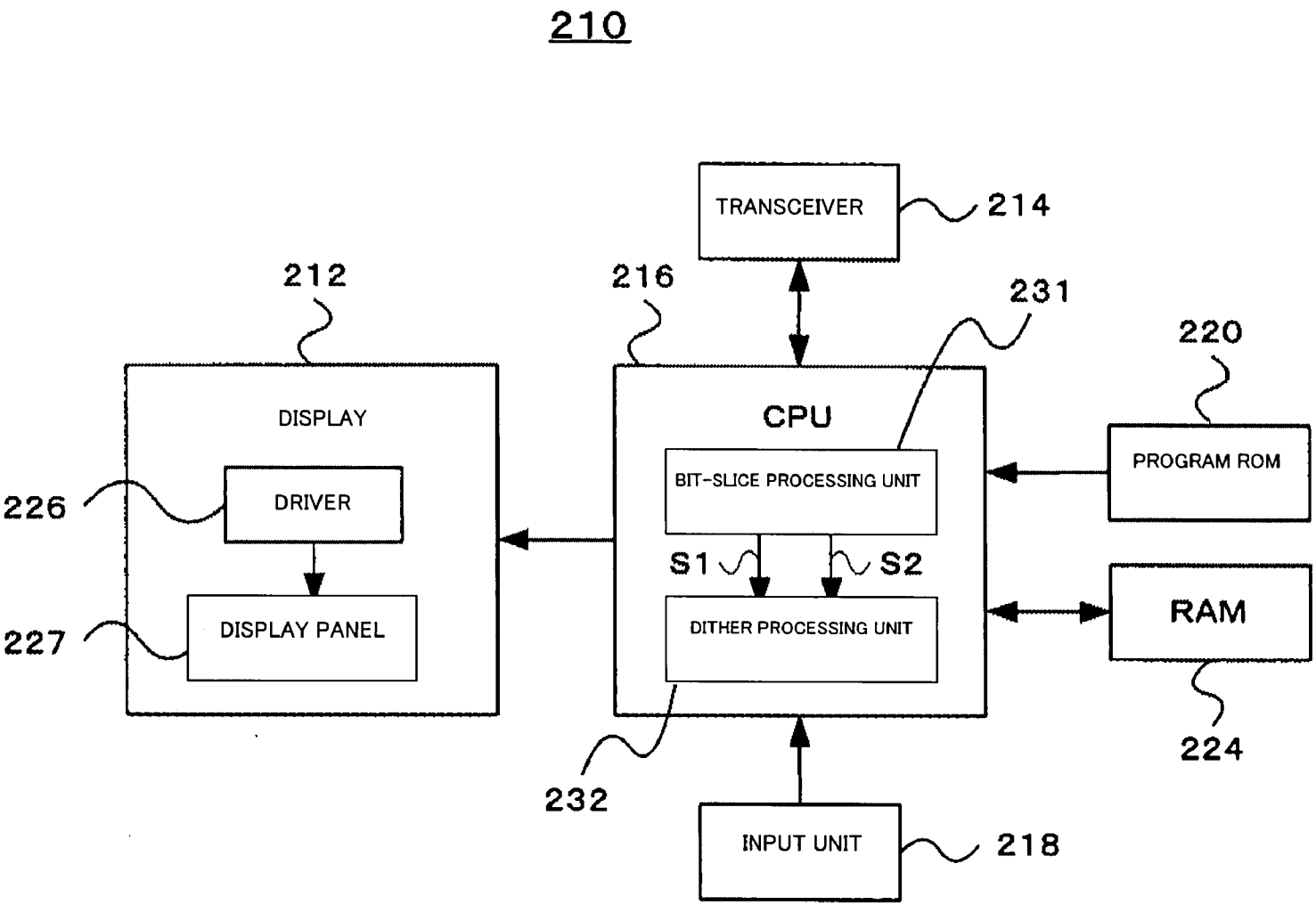
FIG. 1 shows a schematic configuration of a mobile terminal using an image process according to an exemplary embodiment of the invention.

FIG. 1 shows the schematic configuration of a mobile terminal according to an exemplary embodiment of the invention. In this drawing, a mobile terminal 210 is formed as a terminal, such as a mobile phone, a PDA, and so forth. The mobile terminal 210 includes a display 212, a transceiver 214, a CPU 216, an input unit 218, a program ROM 220, and a RAM 224. The display 212 includes a driver 226, a display panel 227, and so forth.

The transceiver 214 can receive contents, such as image data, from outside sources. Here, the details of a data process performed by the mobile terminal 210 will be described, mainly for the case where the mobile terminal 210 receives image data. The mobile terminal 210 receives image data, where a user has access to a server for rendering a contents-providing service by operating the mobile terminal 210 and inputs an instruction for downloading predetermined image data, for example. The image data received by the mobile terminal 210 includes moving-image data and static-image data. Here, the mobile terminal 210 receives RGB 24-bit image data (eight bits for each color) per one pixel. The image data received by the transceiver 214 is transmitted to the CPU 216 or the like. Further, the image data can be stored in the RAM 224.

Where the mobile terminal 210 is formed as the mobile phone, the input unit 218 can be formed as various types of operation buttons. Further, where the mobile terminal 210 is formed as the PDA, the input unit 218 can be formed as a tablet that can detect a touch of a touch pen or the like. Therefore, the user can provide various instructions and make selections by using the input unit 218. The instructions and selection instructions inputted to the input unit 218 are converted to electric signals and transmitted to the CPU 216.

The program ROM 220 stores various programs for performing various functions of the mobile terminal 210. Particularly, according to this embodiment, the program ROM 220 stores a bit-slice-process program for performing a bit-slice process for the image data transmitted from the transceiver 214 and a dither-process program for performing a dither process.

The RAM 224 can be used as a work memory for converting the image data according to a program such as the above-described bit-slice-process program, the dither-process program, and so forth. Further, the RAM 224 can store the image data transmitted from the outside sources to the transceiver 214 and image data obtained from a camera (not shown) mounted on the mobile terminal 210, as required.

The CPU 216 performs the various functions of the mobile terminal 210 by executing various programs stored in the program ROM 220. In this embodiment, the CPU 216 reads and executes the programs stored in the program ROM 220, thereby functioning as a bit-slice-processing unit 231 and a dither-processing unit 232.

First, the bit-slice-processing unit 231 performs a bit-slice process for reducing the image-data amount for image data or the like transmitted from the transceiver 214. For example, where data of eight bits for each of colors R, G, and B is inputted, low-order two bits of each color are reduced, so that data of six bits is obtained. That is to say, where the bit-slice processing unit 231 performs the bit-slice process, image data S1 is generated as the remainder of the data-amount reduction and image data S2 is generated as the data amount reduced from the eight-bit data. The image data S1 and the image data S2 are transmitted to the dither-processing unit 232, respectively. In the above-described example, high-order six-bit data corresponds to the image data S1 and low-order two-bit data corresponds to the image data S2.

Next, the dither-processing unit 232 performs a dither process for inputted image data. More specifically, the dither-processing unit 232 performs the dither process for the inputted image data S1 based on the image data S2 reduced from the eight-bit data. Otherwise, the dither-processing unit 232 combines the high-order-bit image data S1 and the low-order-bit image data S2, thereby generating image data before being subjected to the bit-slice process. Then, the dither-processing unit 232 performs the dither process for the image data S1 based on the generated image data. Since the display 212 formed as the liquid-crystal display or the like cannot display all colors of eight-bit full-color (256 gray scales) image data, the above-described dither process is performed for increasing the gray-scale number simulatively, so as to present the eight-bit full-color image data by using colors of six-bit gray scales, for example. Therefore, though the gray-scale number of element colors corresponds to six bits, it becomes possible to present the colors of the 256 gray scales by presenting the half-tone of the six-bit gray scales simulatively. This dither process is performed for each of colors R, G, and B. The details of the dither process will be described below.

Further, the CPU 216 performs the various functions of the mobile terminal 210 by executing various programs other than the bit-slice-process program and the dither-process program. However, since the other programs do not directly relate to the invention, the description thereof is omitted.

The display 212 is formed as a lightweight and low-profile display, such as an LCD (liquid crystal display), and can include a liquid-crystal display panel 227 and a driver 226 formed as a semiconductor device. The display 212 can function as a processing unit for processing image data transmitted from the CPU 216. Since this function does not directly relate to the invention, the description thereof is omitted.

In FIG. 1, the dither processing unit 232 for performing the dither process is provided in the CPU 216. However, the dither process can be performed in hardware or the like that is separate from the CPU 216.

A dither process according to this exemplary embodiment will now be described. As described above, the dither process is performed by the dither-processing unit 232 provided in the CPU 216. The image data S1 obtained as the remainder of the bit-slice process performed by the bit-slice processing unit 231 and the image data S2 bit-sliced off by the bit-slice-processing unit 231 are inputted to the dither-processing unit 232. In this embodiment, full-color image data of eight bits for each of colors R, G, and B is inputted to the bit-slice processing unit 231. Further, the high-order six bits of the data is inputted to the dither-processing unit 232, as the image data S1, and the low-order two bits of the data is inputted to the dither processing unit 232, as the image data S2.

Since the display 212 formed as the liquid-crystal display or the like cannot display all colors of eight-bit full-color (256 gray scales) image data, the dither process of this embodiment is performed for increasing the gray-scale number simulatively, so as to present the eight-bit full-color data by using colors of six-bit gray scale, for example. Therefore, though the gray-scale number of element colors corresponds to six bits, it becomes possible to present the colors of the 256 gray scales by presenting the half tone of the six-bit gray scales simulatively.

Figure 2:
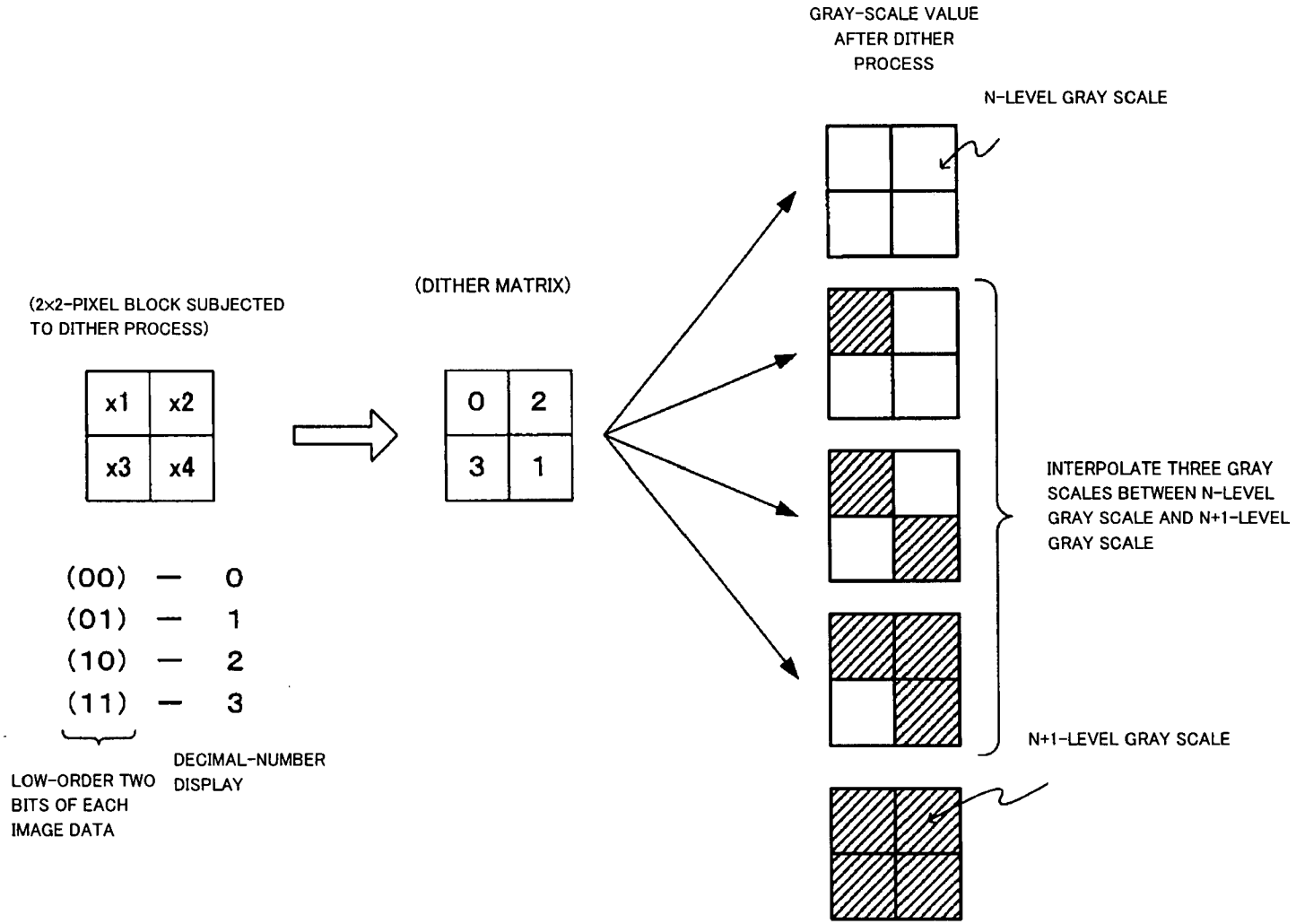
FIG. 2 illustrates a summary of a dither process according to the exemplary embodiment of the invention.

The dither processing will now be described in detail with reference to FIG. 2. The high-order six bits referred to as the image data S1 and the low-order two bits referred to as the image data S2 of each of a plurality of items of data are transmitted to the dither processing unit 232 of the CPU 216, as image data corresponding to one image. The gray-scale values of the image data S1 are the same as one another and those of the image data S2 are different from one another. Here, the gray-scale values of the image data S2 are "00", "01", "10", and "11". Each of the low-order-two-bit values is indicated by decimal number for the sake of description. In the following description, "00" is represented by "0", "01" is represented by "1", "10" is represented by "2", and "11" is represented by "3". Further, in this example, the gray-scale value of the common high-order six-bit data is "N". The "N"-level gray scale corresponds to a predetermined gray scale of 64 gray scales. In FIG. 2, the gray-scale value of a block having a "white" color is "N" and that of a block filled with "oblique lines" is "N+1".

A dither matrix is shown at the center of FIG. 2. Here, an example 2×2 dither matrix is shown. In this drawing, numbers written in the square blocks form the dither matrix. These numbers are used for comparing inputted low-order two bits to the numbers represented by decimal numbers ("0", "1", "2", and "3"). That is to say, the numbers shown in the blocks function as threshold values used for performing the dither process.

Next, the dither process performed by using the above-described 2×2 dither matrix will be described. The dither process is performed for a set of pixels of the same size as that of the dither matrix (hereinafter referred to as block) as a unit. That is to say, the 2×2 dither matrix is used for each of blocks including length-to-width 2×2 pixels of image data subjected to the dither process as a unit. An example 2×2-pixel block is shown on the left of FIG. 2. This block is formed by four pixels including ×1 to ×4 pixels. For each of the pixels, the high-order six bits are transmitted from the bit-slice processing unit 231, as the image data S1, and the low-order two bits are transmitted from the bit-slice processing unit 231, as the image data S2.

Figure 3A:
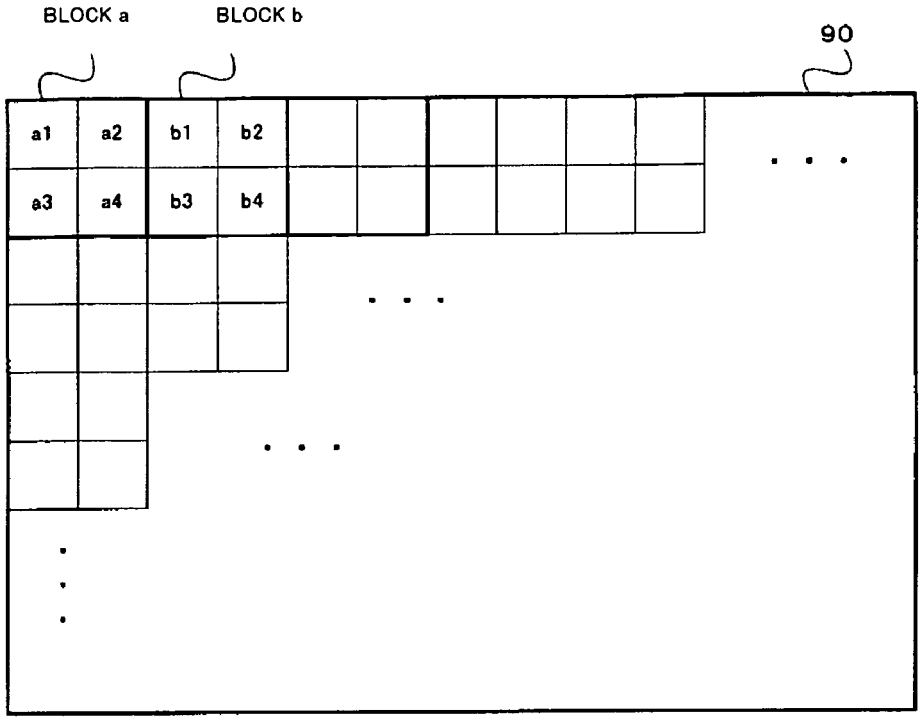
FIGS. 3(*a*) and 3(*b*) illustrate a dither process using a 2×2 dither matrix.
Figure 3B:
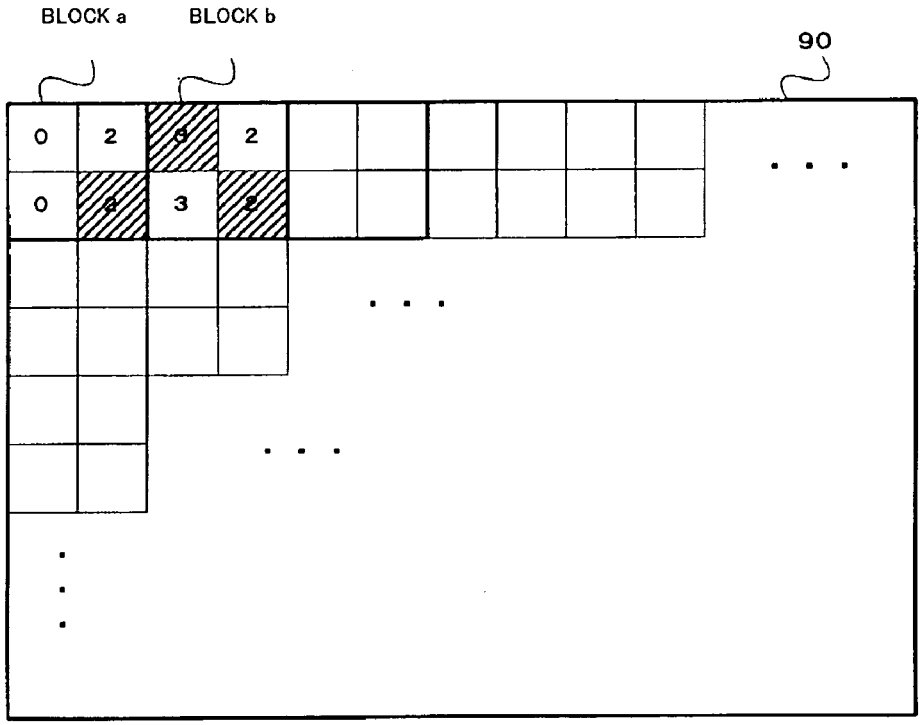

FIG. 3(*a*) schematically shows a method for using the 2×2 dither matrix for a predetermined rectangular image data. For example, an example where rectangular image data 90 is subjected to the dither process will be described. First, the 2×2 dither matrix is used for a 2×2-pixel block a on the upper left corner, so as to determine the gray-scale value of each of the four pixels after the dither process. Next, the position of the dither matrix with reference to the image data 90 subjected to the dither process is shifted to the right by as much as two pixels, so that the dither process is used for the next 2×2-pixel block b in the above-described manner. Thus, the dither process is performed for each 2×2-pixel block by shifting the dither matrix by as much as two pixels.

For each pixel, the value of the low-order two bits (the image data S2) of image data corresponding to the pixel is compared to a threshold value corresponding to the pixel in the 2×2 dither matrix. For example, as for a pixel al at the upper left of the block a shown in FIG. 3(*a*), the value of the low-order two bits of the image data is compared to a threshold value "0" at the upper left of the dither matrix shown in FIG. 2. Further, as for a pixel b4 at the lower right of a block b shown in FIG. 3(*a*), the value of the low-order two bits of the image data is compared to a threshold value "1" at the lower right of the dither matrix shown in FIG. 2. Where the low-order two-bit value of each of the pixels is lower than the threshold value, the gray-scale value of the pixel is determined to be "N". Where the low-order two-bit value of each of the pixels is higher than the threshold value, the gray-scale value of the pixel is determined to be "N+1".

FIG. 3(*b*) shows a specific example. FIG. 3(*b*) shows example low-order two-bit values of pixels in the blocks a and b shown in FIG. 3(*a*). That is to say, in the case of the block a, a1=0, a2=2, a3=0, and a4=2 hold. In the block a, where the low-order two-bit value of each pixel is compared to the threshold value of the dither matrix at a position corresponding to the pixel, only the pixel a4 is higher than the threshold value. Therefore, the gray-scale value of only the pixel a4 is represented by "N+1" (oblique lines) and the gray-scale values of the other three pixels are represented by "N". Similarly, in the block b, only the gray-scale values of the pixels b1 and b4 are higher than the threshold values. Therefore, the gray-scale values of the pixels b1 and b4 are represented by "N+1" and those of the other pixels are represented by "N".

Where the 2×2 dither matrix is used for a 2×2-pixel block as a unit, the gray-scale value of each block after the dither process corresponds to any one of four patterns shown on the right side of FIG. 2. Subsequently, it becomes possible to interpolate three half-tone gray scales between the N-level gray scale and the N+1-level gray scale simulatively. In other words, it becomes substantially possible to represent colors of the 256 gray scales by increasing the number of gray scales simulatively by using a combination of roughly cut colors of the 64 gray scales instead of the finely cut colors of the 256 gray scales.

Figure 4:
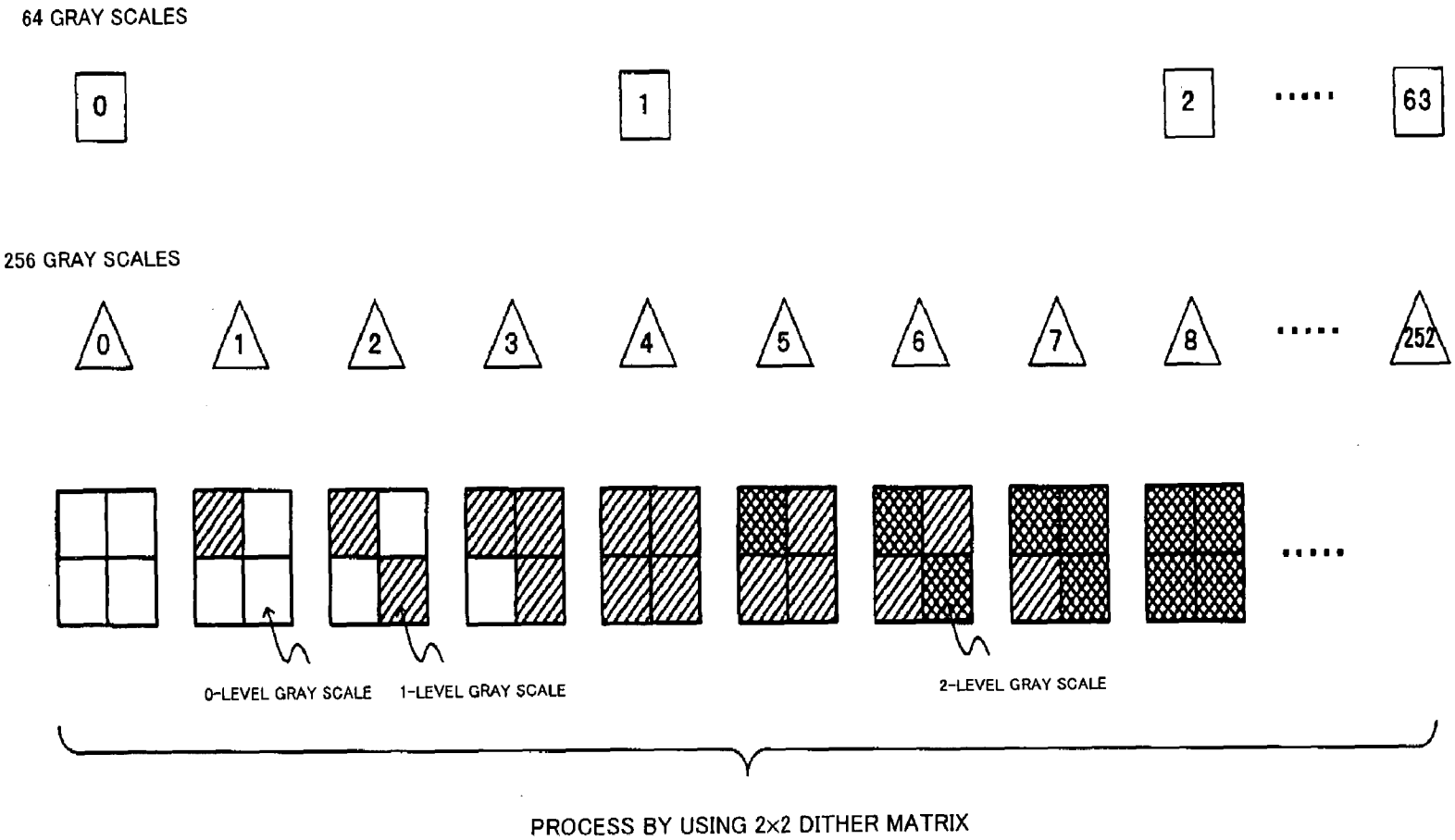
FIG. 4 shows an example where half-tone gray scales are interpolated simulatively by performing the dither process, so as to represent 256 gray scales.

FIG. 4 shows an example where the above-described dither process is performed for inputted data of the 256 gray scales. Numbers in squares on an upper level in this drawing denote steps of the 64 gray scales. Steps of the 256 gray scales are shown in triangles on a lower level. Here, data of the 256 gray scales (including the image data S1 and S2) is inputted to the CPU 216. The CPU 216 performs the dither process, so as to represent the colors of the 256 gray scales by using only the colors of the 64 gray scales. Simulatively represented colors of the 256 gray scales by using only the colors of the 64 gray scales are shown on the lower-most level. In this drawing, oblique lines or the like shown in blocks represent the colors of the 64 gray scales. Colors of the 256 gray scales corresponding to multiples of four agree with the colors of the 64 gray scales. Therefore, four blocks are filled with the same color. On the other hand, colors of gray scales that do not correspond to the multiples of four are represented simulatively by using a combination of colors of the gray scales corresponding to the multiple of four at both ends.

However, where the above-described dither process is performed evenly for every inputted data of the 256 gray scales, so as to interpolate three gray scales simulatively between the steps of the 64 gray scales, only 253 gray scales are represented, as described above. This is because the number of gaps between the 256 gray scales is smaller than the gray-scale number by as much as one.

A method according to a first exemplary embodiment will now be described. Where three gray scales are interpolated evenly between the gaps of the 64 gray scales in the above-described manner, the gray-scale number becomes 3 short of 256. Therefore, in this embodiment, interpolation is performed for the three gray-scale shortage. More specifically, the dither process is performed by using a dither matrix of a predetermined size larger than that of the other for a predetermined area of the 256 gray scales. Subsequently, it becomes possible to fully represent the colors of the 256 gray scales by using only the colors of the 64 gray scales. The process according to this embodiment can be performed by the CPU 216 including the above-described dither processing unit 232 or the like.

Figure 5:
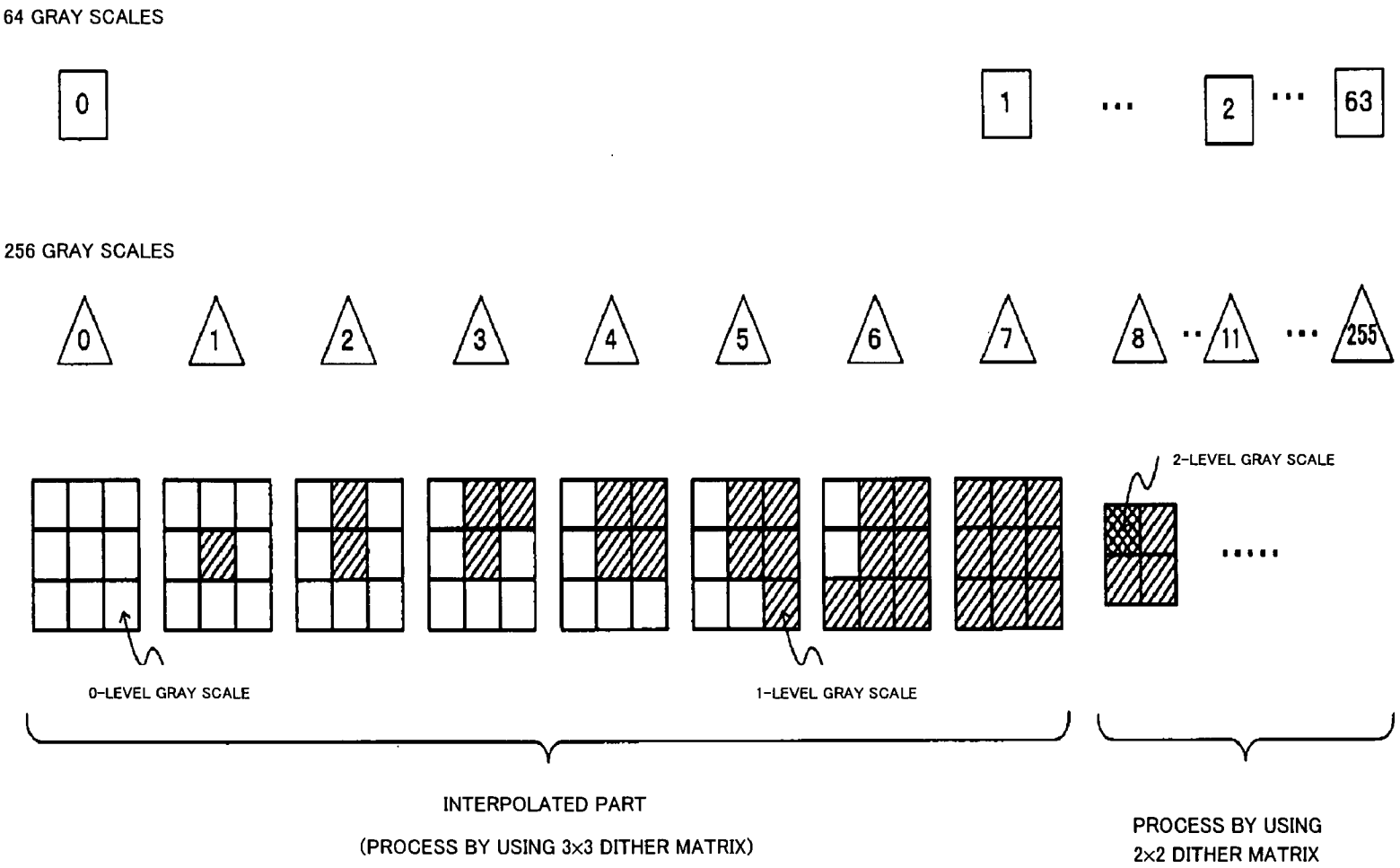

First, an exemplary embodiment 1a will be described with reference to FIG. 5. The steps of the 64 gray scales are shown as numbers in squares on an upper level in FIG. 5. Further, the steps of the 256 gray scales are shown as numbers in triangles on a lower level. Further, patterns simulatively representing the 256 gray scales by using the colors of the 64 gray scales through the dither process are shown on a lower-most level. In this drawing, the "oblique lines" or the like shown in blocks represent the colors of the 64 gray scales.

A specific processing method according to the embodiment 1a will now be described. In this embodiment, a predetermined process is performed by using a 3×3 dither matrix for each gap between a 0-level gray scale and a 1-level gray scale of the 64 gray scales. That is to say, six gray scales are interpolated between the 0-level gray scale and the 1-level gray scale.

Figure 6A:
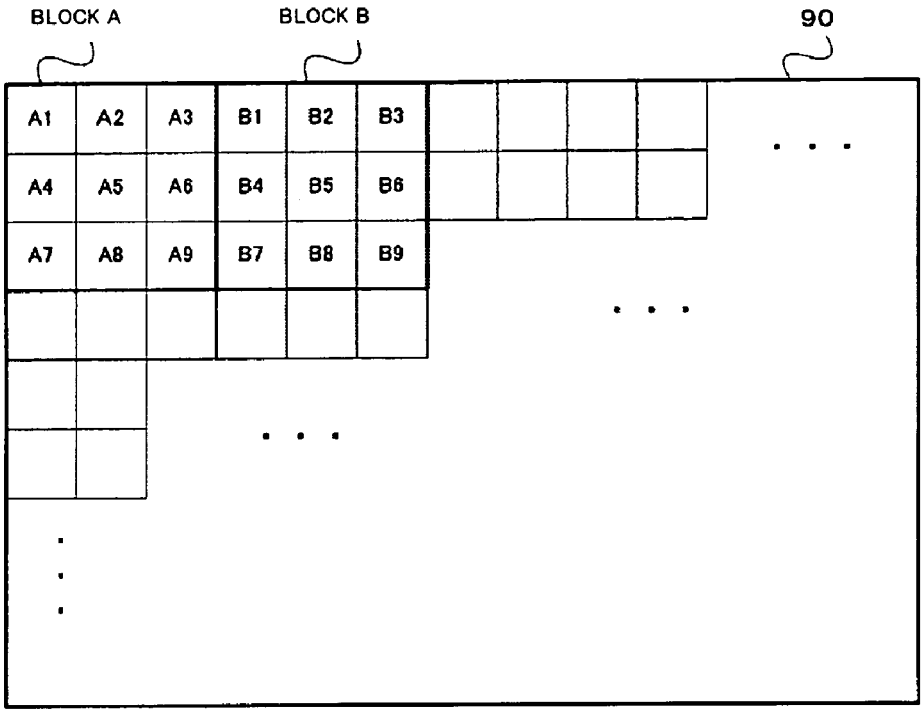
FIGS. 6(*a*) and 6(*b*) illustrate a dither process using a 3×3 dither matrix.
Figure 6B:
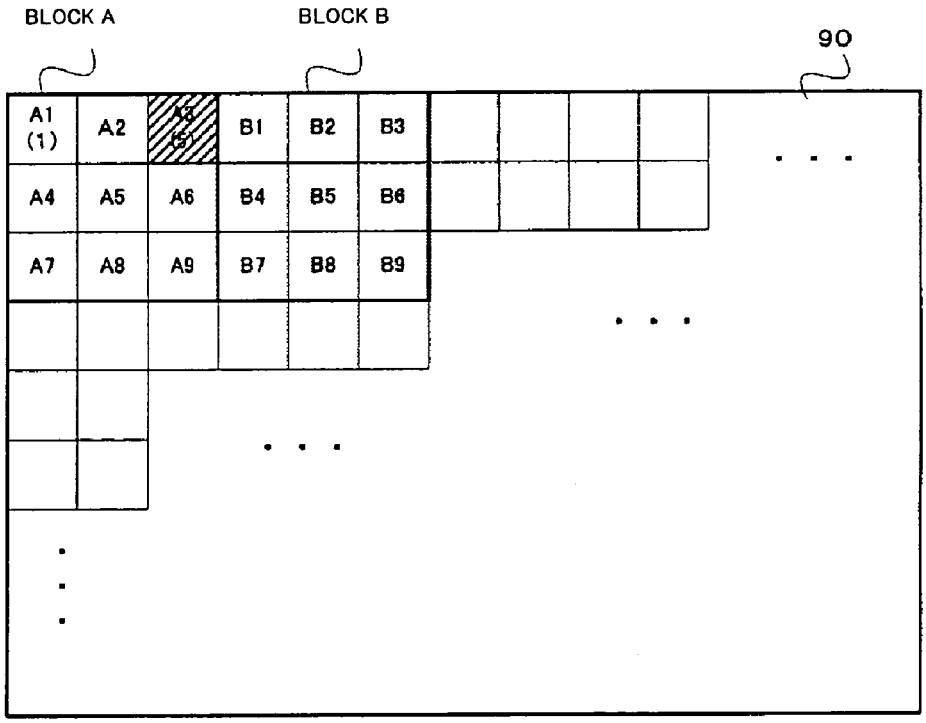

As shown in FIG. 6(*a*), the 3×3 dither matrix is used for each block including length-to-width 3×3 pixels of rectangular image data 90 subjected to the process as a unit. For example, as shown in this drawing, the 3×3 dither matrix is used for a block A including length-to-width 3×3 pixels on the upper left of the image data subjected to the process. Next, the 3×3 dither matrix is used for a 3×3 block B to the right. Thus, the 3×3 dither matrix is shifted in that order. Threshold values in the 3×3 dither matrix are determined in a suitable manner. Subsequently, it becomes possible to generate seven types of combinations of an N-level gray scale and an N+1-level gray scale after the 3×3 dither process. The combinations can be used for the pixels 0 to 6 of the 256 gray scales shown as the numbers in triangles in FIG. 5. As a result, six gray scales can be interpolated between the data 0 to 1 of the 64 gray scales.

A specific example is shown in FIG. 6(*b*). A pixel A1=1 (for representing 256 gray scales) on the upper-left corner of the block A is considered. Referring to FIG. 5, where the dither process is performed for a 3×3 pixel block corresponding to the 1-level gray scale, only the gray-scale value at the center of the 3×3 pixel block is represented by N+1 (see oblique lines). The other gray-scale values are represented by N. Therefore, the gray-scale value of the upper-left pixel A1 is represented by N. That is to say, the value of the gray scale thereof becomes zero. Then, a pixel A3=5 on the upper-right corner of the block A is considered. Referring to FIG. 5, where the dither process is performed for a 3×3 pixel block corresponding to a 5-level gray scale, the gray-scale values of upper two pixels on the center column and entire three pixels on the right column are represented by N+1 (see oblique lines). Therefore, the gray-scale value of the upper-right pixel A3 is represented by N+1, that is, one. Thus, the 3×3 dither matrix is used for pixels 0 to 6 of the 256 gray scales, so as to determine the gray-scale values of the pixels 0 to 6. Patterns on the lower-most level shown in FIG. 5 denote the determined gray-scale values. In this manner, six gray scales can be interpolated simulatively between the gray scales 0 and 1 for representing the 64 gray scales.

However, pixels that represent the 64 gray scales and that have gray-scale values higher than one are represented by using the 2×2 dither matrix in the above-described manner. Subsequently, the final number of interpolated gray scales is shown as 62×3+6=192. Therefore, it becomes possible to represent the 256 gray scales by using the colors of the 64 gray scales.

Figure 7:
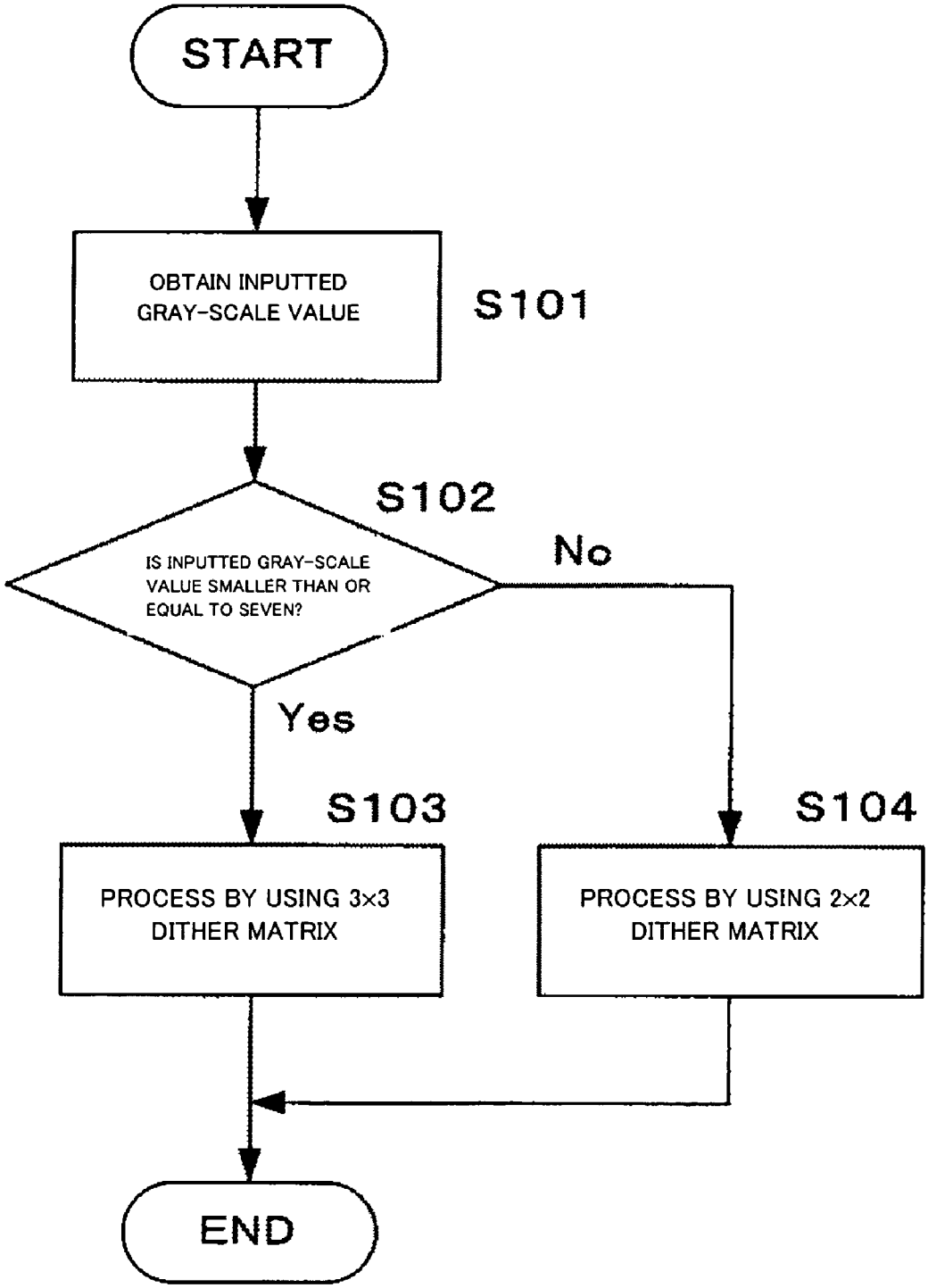

Next, the above-described process performed by the dither processing unit 232 of the CPU 216 will be described with reference to a flowchart shown in FIG. 7.

First, at step S101, the dither processing unit 232 of the CPU 216 obtains image data to be displayed from the bit-slice-processing unit 231. The obtained image data includes the image data S1 having six bits obtained by performing the bit-slice process for the full-color data of eight bits for each of colors R, G, and B, and the image data S2 including the low-order two bits. Next, at step S102, the dither processing unit 232 calculates the gray-scale values of the obtained image data for representing the 256 gray scales based on the image data S1 and the image data S2. Then, the dither processing unit 232 determines whether or not the gray-scale values are smaller than or equal to seven. Actually, this determination can be easily performed by comparing the value of (the gray-scale value+1) to "8".

Here, where the gray-scale value is smaller than or equal to seven (for representing the 256 gray scales), (step S102; Yes), the process advances to step S103, so that the dither process is performed by using the 3×3 dither matrix in the above-described manner. However, where the gray-scale value of the inputted data is larger than seven (step S103; No), the process advances to step S104, so that the dither process is performed by using the 2×2 dither matrix. At step S104, the data with gray-scale values smaller than or equal to seven is represented by colors of from 0 to 1-level gray scales (for representing the 64 gray scales). (That is to say, three gray scales are added.) Since the gray scales larger than seven are allocated for the two-level gray scale or higher, three is subtracted from the inputted gray-scale value and the dither process shown in FIG. 2 is performed therefor.

Figure 8:
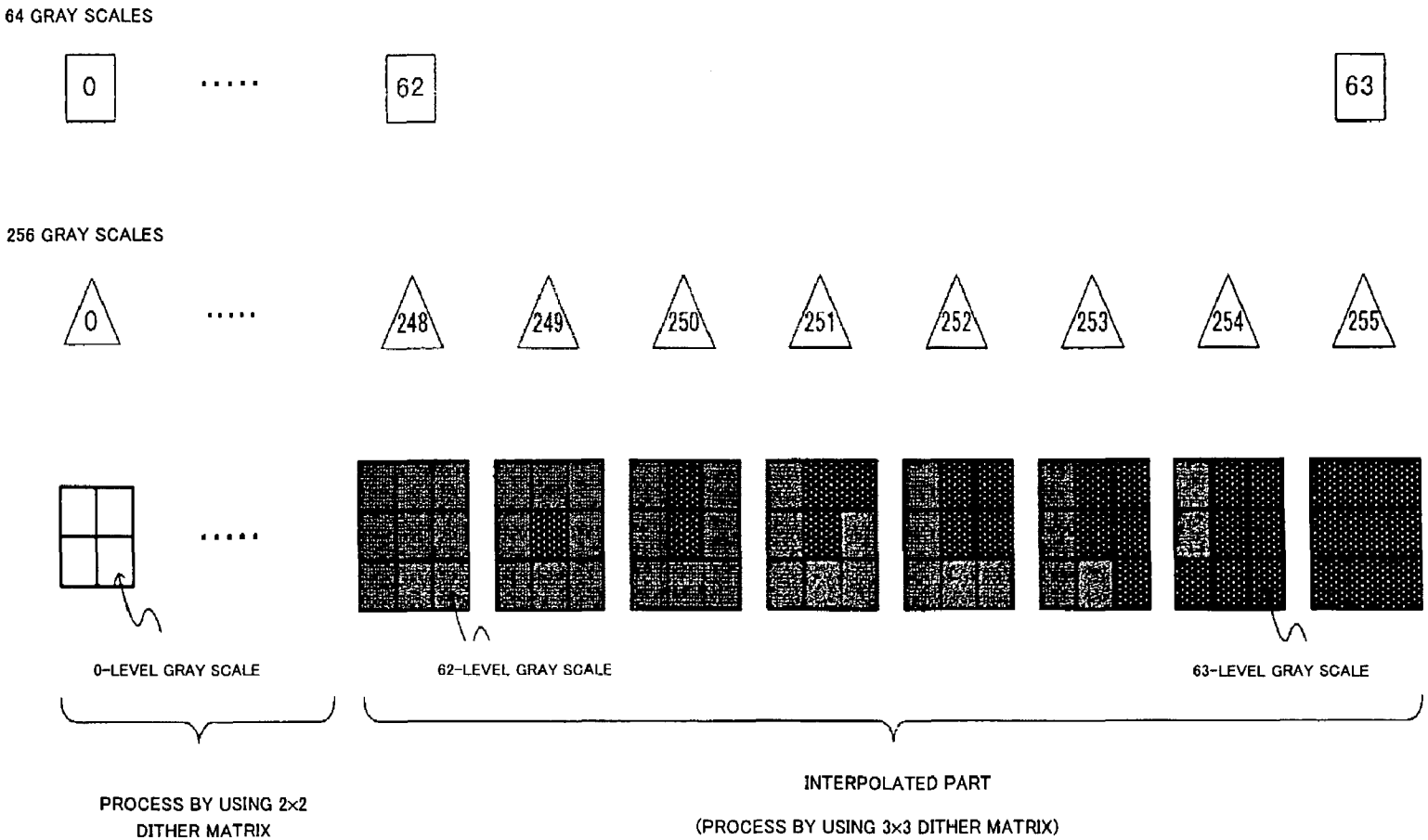
FIG. 8 illustrates an interpolation method performed through a dither process according to an exemplary embodiment 1b.

Next, a processing method according to an exemplary embodiment 1b will be described. In the embodiment 1a, interpolation is performed for a lowest area (that is, the 0-level gray scale to the 1-level gray scale) by using the 3×3 dither matrix. However, in the embodiment 1b, the 3×3 dither process is performed for gray scales in a highest area. FIG. 8 illustrates an example process according to the embodiment 1b. As shown in this drawing, the dither process is performed for 0 to 247-level gray scales for representing the 256 gray scales (0 to 62-level gray scales for representing the 64 gray scales) by using the 2×2 dither matrix. However, the dither process is performed for 248 to 255-level gray scales for representing the 256 gray scales (62 to 63-level gray scales for representing the 64 gray scales) by using the 3×3 dither matrix, as described above. Subsequently, it becomes possible to represent the entire colors of the 256 gray scales simulatively by using only the colors of the 64 gray scales, as in the embodiment 1a.

In the process performed by the dither processing unit 232 of the CPU 216, it is determined whether or not the inputted gray-scale value is smaller than 247 or larger than 248. Where the gray-scale value is smaller than or equal to 247, the process is performed by using the 2×2 dither matrix. Where the gray-scale value is larger than 248, the process is performed by using the 3×3 dither matrix.

In an exemplary embodiment 1c, a process for interpolating the shortage of three gray scales is performed by using the 3×3 dither matrix, as in the above-described embodiments 1a and 1b. In the embodiment 1c, the process using the 3×3 dither matrix can be performed for a predetermined half-tone gray-scale area, without being limited to the lowest gray-scale area (0 to 1-level gray scales), of the highest gray-scale area (62 to 63-level gray scales). That is to say, the 3×3 dither process is performed for a predetermined intermediate area including seven gray scales. In the other areas, conversion is performed by using the 2×2 dither matrix.

In the process performed by the dither processing unit 232 of the CPU 216, it is determined whether or not an inputted gray-scale value is smaller than the value of a predetermined area, or larger than that. Further, it is determined whether or not the inputted gray-scale value corresponds to the value of the predetermined area. Where the inputted gray-scale value does not correspond to the value of the predetermined area, the CPU 216 performs the process by using the 2×2 dither matrix. Where the inputted gray-scale value corresponds to the value of the predetermined area, the CPU 216 performs the process by using the 3×3 dither matrix. Further, where the inputted gray-scale value corresponds to the value of an area higher than the predetermined area, three is subtracted from the inputted gray-scale value and the process is performed therefor by using the 2×2 dither matrix.

A process according to a second exemplary embodiment will now be described. In the above-described first embodiment, the 3×3 dither matrix is used for a predetermined gray-scale value, so as to interpolate the shortage of three gray scales. In this embodiment, however, the process is performed by using only the 2×2 dither matrix. According to a summary of this embodiment, half-tone gray scales are represented simulatively by using a three-value dither matrix (a matrix including gray-scale values corresponding to three steps) in the dither process.

Figure 9:
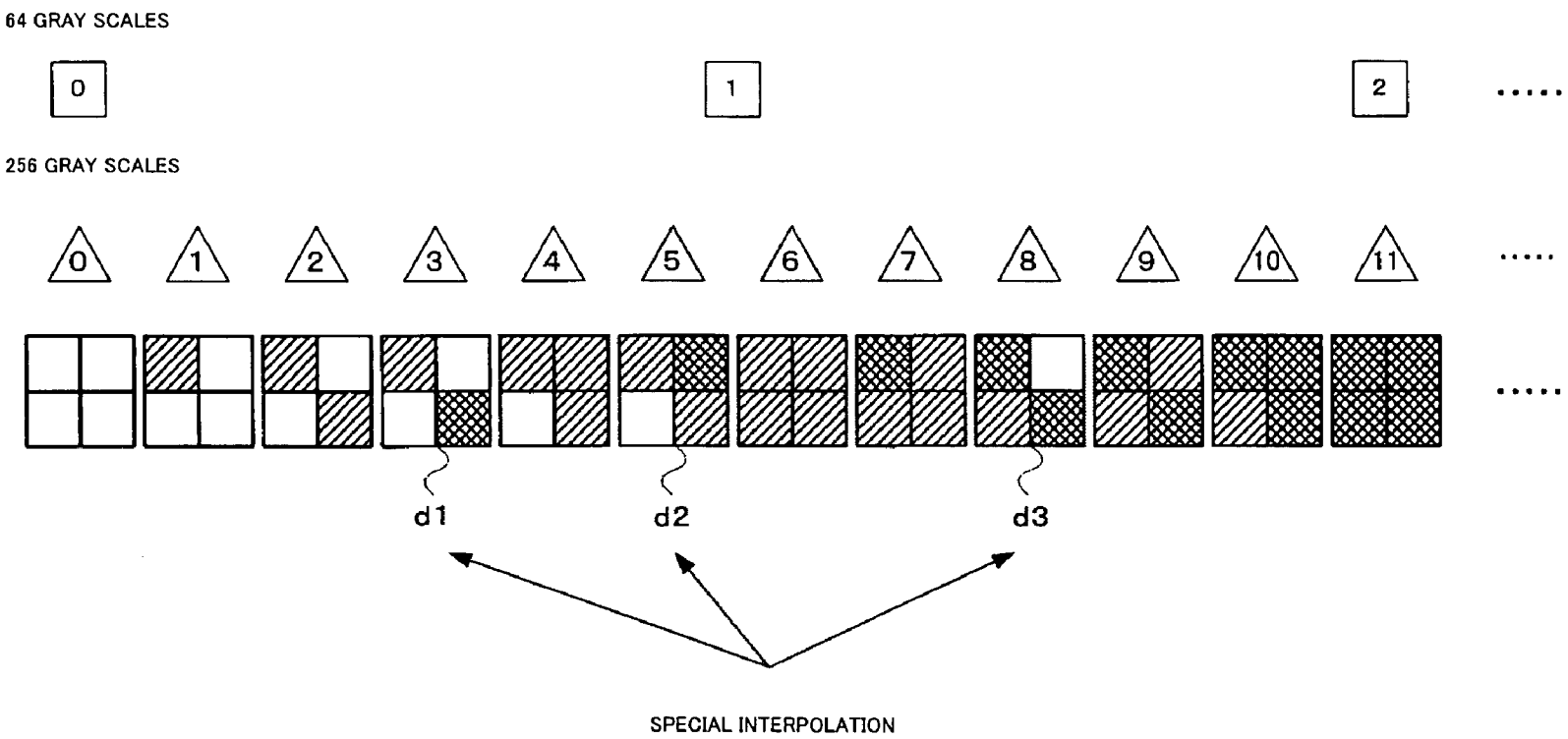
FIG. 9 illustrates an interpolation method performed through a dither process according to an exemplary embodiment 2.

This embodiment will be described more specifically with reference to FIG. 9. Steps of the 64 gray scales are shown by numbers in squares on an upper level of this drawing and steps of the 256 gray scales are shown by numbers in triangles on a lower level. Further, on the lower-most level, the 256 gray scales are simulatively represented by the colors of the 64 gray scales through the dither process. In this drawing, the lack of three gray scales is interpolated between the 0-level gray scale and 2-level gray scale for representing the 64 gray scales. More specifically, a dither matrix d1 is used for a 3-level gray scale of the 256 gray scales, a dither matrix d2 is used for a 5-level gray scale thereof, and a dither matrix d3 is used for an 8-level gray scale. These dither matrixes d1, d2, and d3 are represented by using three gray scales (the 0-level gray scale, the 1-level gray scale, and the 2-level gray scale are used for representing the 64 gray scales). Further, for gray scales later than the three-level gray scale of the 64 gray scales (gray scales later than the 12-level gray scale of the 256 gray scales), the 2×2 dither process is performed by using ordinary two values (that is, the gray-scale values N and N+1). Subsequently, it becomes possible to represent the entire 256 gray scales by using the 64 gray scales. The process according to this embodiment can be performed by the CPU 216 including the above-described dither processing unit 232.

Figure 10:
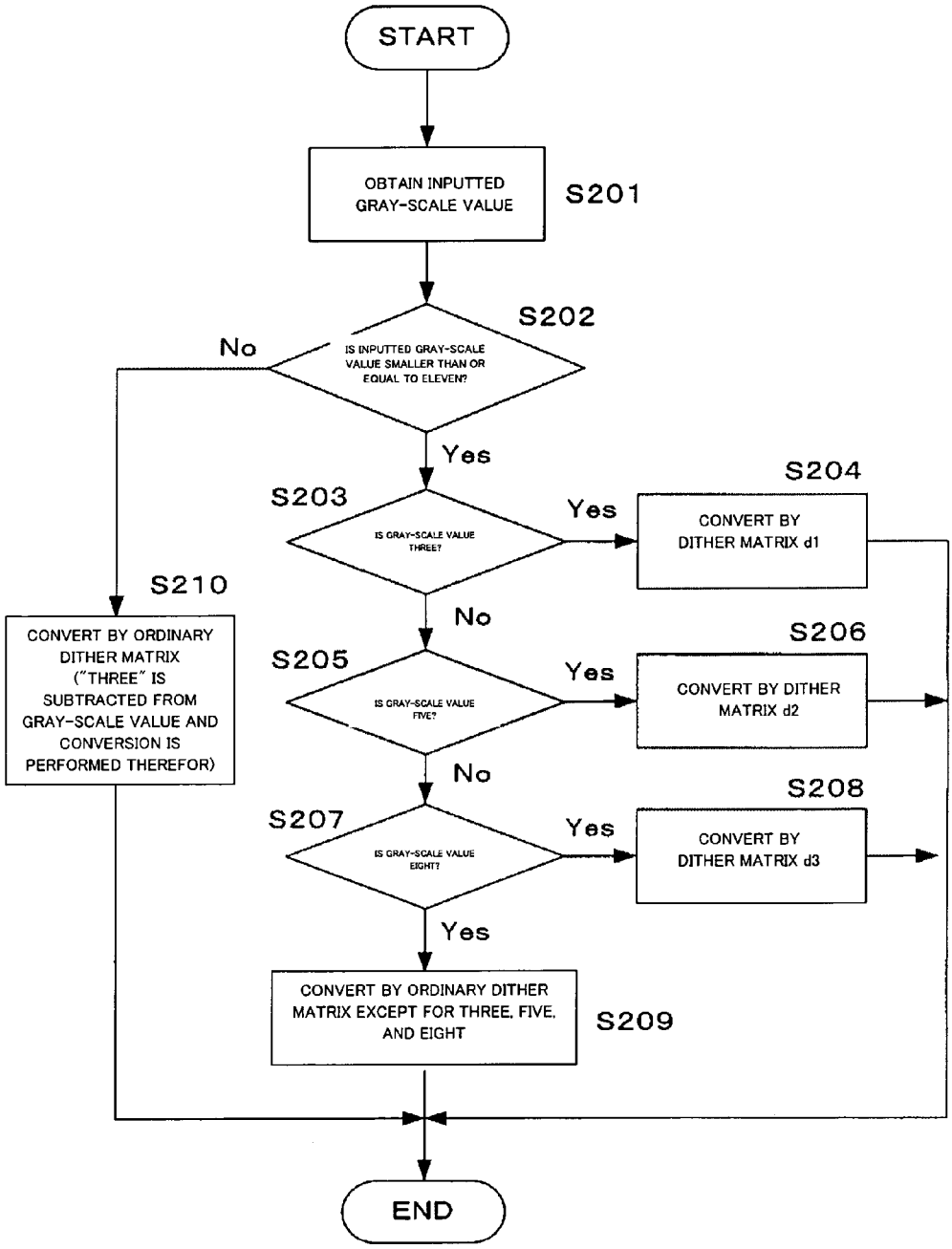

A process according to an exemplary embodiment 2a for performing the above-described method will be described with reference to a flowchart shown in FIG. 10. This process is performed by the dither processing unit 232 in the CPU 216. The process using the three gray scales is performed only for data having a predetermined gray-scale value. Therefore, it is determined whether or not an inputted gray-scale value is the predetermined gray-scale value. The dither process is performed for data having the predetermined gray-scale value in this area by using the above-described special dither matrix.

First, at step S201, the dither processing unit 232 obtains the image data S1 corresponding to high-order six bits and the image data S2 corresponding to low-order two bits from the bit-slice-processing unit 231. Next, at step S202, the dither processing unit 232 determines whether or not a gray-scale value for representing the 256 gray scales indicated by the image data S1 and S2 is smaller than or equal to the value of a 11-level gray scale. Where the gray-scale value is smaller than or equal to eleven (step S202; Yes), the process advances to step S203.

At step S203, it is determined whether or not the gray-scale value is three. If the gray-scale value is three (step S203; Yes), the dither process is performed by using the dither matrix d1, at step S204. However, where the gray-scale value is not three (step S203; No), it is determined whether or not the gray-scale value is five, at step S205. Where the gray-scale value is five (step S205; Yes), the dither process is performed by using the dither matrix d2, at step S206. Where the gray-scale value is not five (step S205; No), it is determined whether or not the gray-scale value is eight, at step S207. Where the gray-scale value is eight (step S207; Yes), the dither process is performed by using the dither matrix d3, at step S208.

Where the gray-scale value is smaller than or equal to eleven and not any one of three, five, and eight, the ordinary dither process (that is, the dither process by using the two-value dither matrix) is performed, at step S209. Here, the ordinary dither process is performed for gray-scale values other than the gray-scale values three, five, and eight that are subjected to the special dither process. More specifically, the dither process is performed for gray-scale values smaller than or equal to two (zero, one, and two), as they are. However, where the gray-scale value is four, one is subtracted from the gray-scale value (that is, three), and the ordinary dither process is performed therefor. Where the gray-scale value is either six or seven, two is subtracted from the gray-scale value (that is, four or three), and the ordinary dither process is performed therefor. Further, where the gray-scale value is larger than or equal to nine, three is subtracted from the gray-scale value, and the ordinary dither process is performed therefor.

However, where the gray-scale value is larger than or equal to twelve (step S202; No), the process advances to step S210, so as to perform the ordinary dither process in the above-described manner. Since the special dither process is performed for data in an area where the gray-scale value is smaller than or equal to eleven, three is subtracted from the gray-scale value, and the ordinary dither process is performed therefor.

In the above-described embodiment, the process by using the dither matrix including three gray-scales is performed for a predetermined area corresponding to the gray-scale values zero to eleven. However, the process may be performed without being limited to the above-described embodiment. That is to say, the same process can be performed for any predetermined area, as described in the first embodiment.

Next, another exemplary embodiment different from the above-described embodiments will be described. In the embodiment 2a, the special process is performed only for the predetermined gray-scale value. However, according to a method of this embodiment, the dither process can be performed for the entire gray-scale values by using a new dither matrix. The dither process by using the new dither matrix is performed only for data in a predetermined area. A result of the dither process according to the embodiment 2a is the same as that of the dither process according to the embodiment 2b, as shown in FIG. 9.

A process according to this embodiment will now be described with reference to FIG. 11. This drawing shows the above-described newly provided dither matrix. FIG. 11(*a*) shows a dither matrix used for a gray-scale value smaller than or equal to six for representing the 256 gray scales. FIG. 11(*b*) shows a dither matrix used for a gray-scale value larger than or equal to seven. Here, the dither matrix shown in FIG. 11(*a*) is determined to be Table 1 and the dither matrix shown in FIG. 11(*b*) is determined to be Table 2. Numbers in blocks of the above-described tables function as threshold values for performing the above-described processes. Where an inputted gray-scale value is larger than the threshold value, it is converted to a gray-scale value obtained by adding one to a gray-scale value N representing high-order six bits. Otherwise, the inputted gray-scale value is left as the gray-scale value N representing the high-order six bits.

In this embodiment, numbers other than the threshold values are provided in the blocks of the tables. In FIG. 11, numbers written in parentheses correspond to the above-described numbers. Where an inputted gray-scale value is the same as the number, a special process is performed. In the case of Table 1, where the inputted gray-scale value is the same as the number in the parentheses, the inputted gray-scale value is converted to an (N+2) gray scale. For example, where the gray-scale value of an upper-right pixel of a 2×2-pixel block is five, the gray-scale value is the same as the number written in parentheses in an upper-right block of Table 1. Therefore, the corresponding part is converted into an (N+2) gray scale. On the other hand, in the case of Table 2, where an inputted value is the same as the number in parentheses, the corresponding part is converted into an N gray scale. For example, where the gray-scale value of the upper-right pixel of the 2×2-pixel block is eight, the gray-scale value is the same as the number written in parentheses of the upper-right block. Therefore, the corresponding part is converted into the N gray scale. By performing the above-described dither process, the 256 gray scales can be represented simulatively by using the 64 gray scales, as shown in FIG. 9.

Figure 12:
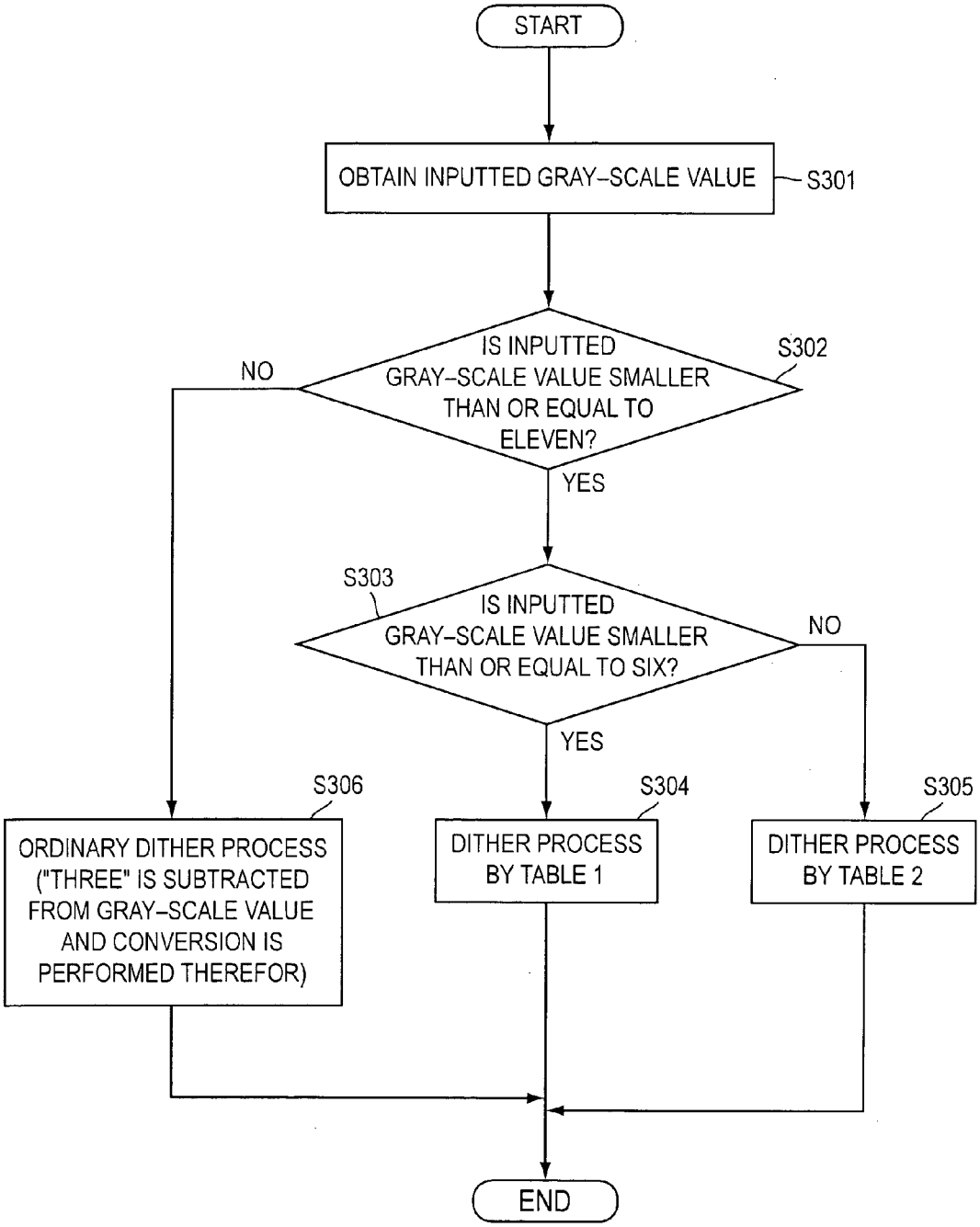
FIG. 12 shows a flowchart according to the exemplary embodiment 2b.

Next, the flow of a process according to this embodiment will now be described with reference to FIG. 12. This process has a step for determining whether or not the inputted gray-scale value corresponds to a predetermined area using either Table 1 or Table 2. The process also has a step for determining which of Table 1 and Table 2 is to be used, where the inputted gray-scale value corresponds to the predetermined area. The above-described processing procedures are performed by the dither processing unit 232 in the CPU 216.

First, the dither processing unit 232 receives the image data S1 corresponding to the high-order six bits and the image data S2 corresponding to the low-order two bits from the bit-slice processing unit 231, at step S301. Next, it is determined whether or not the gray-scale value of the inputted image data (for representing the 256 gray scales) is smaller than or equal to eleven, at step S302. Where the gray-scale value is smaller than or equal to eleven (step S302; Yes), the process advances to step S303.

It is determined whether or not the gray-scale value is smaller than or equal to six, at step S303. Where the gray-scale value is smaller than or equal to six (step S303; Yes), the process advances to step S304, so that the above-described dither process using Table 1 is performed. Where the gray-scale value is not smaller than or equal to six (step S303; No), the process advances to step S305, so that the dither process using Table 2 is performed.

On the other hand, where the gray-scale value is larger than or equal to twelve (step S302; No), the process advances to step S306, so that the ordinary dither process is performed. At this time, the special dither process is performed for data in an area where the gray-scale value is smaller than or equal to eleven. Therefore, three is subtracted from the gray-scale value and the ordinary dither process is performed therefor.

In the above-described exemplary embodiment, the process by using the dither matrix including three gray scales is performed for the predetermined area corresponding to the gray-scale values zero to eleven. However, the process may be performed without being limited to the above-described embodiment. That is to say, the same process can be performed for any predetermined area, as described in the first exemplary embodiment.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An image-display apparatus, comprising:

an image display that can display n-bit gray scales;

an image-data obtaining device that obtains m-bit image data to be displayed, all obtained image data being from a same image and having a same resolution;

a bit-number decreasing device that decreases a number of bits of the image data from m to n;

an interpolation device that interpolates a predetermined number of gray scales for the n-bit image data by performing a dither process and generating interpolation image data having a predetermined number of gray scales corresponding to the m bits; and a display control device that displays the interpolation image data on the image display, the interpolation device performing the dither process by using a second dither matrix, where a gray-scale value of the m-bit image data corresponds to a predetermined area, and performing the dither process by using a first dither matrix, where the gray-scale value does not correspond to the predetermined area; and the interpolation device performing the dither process by using the second dither matrix only for image data having a predetermined gray-scale value of the m-bit image data.

2. The image-display apparatus according to claim 1, the first dither matrix being a 2×2-pixel matrix and the second dither matrix being a 3×3-pixel matrix.

3. The image-display apparatus according to claim 1, the bit-number decrease device using high-order n bits of the m-bit image data, as the n-bit image data.

4. The image-display apparatus according to claim 1, the m bits being eight bits, the n bits being six bits, and a number of gray scales corresponding to the m bits is 256.

5. The image-display apparatus according to claim 4, the interpolation device increasing the image data by as much as 186 gray scales by performing the dither process using the first dither matrix and increasing the image data by as much as 6 gray scales by performing the dither process using the second dither matrix.

6. An image-display method performed by an image-display apparatus comprising an image display that can display n-bit gray scales, the image-display method comprising:

obtaining m-bit image data to be displayed, all obtained image data being from a same image and having a same resolution;

decreasing the number of bits of the image data from m bits to n bits;

interpolating a predetermined number of gray scales for the n-bit image data by performing a dither process and generating interpolation image data having a predetermined number of gray scales corresponding to the m bits; and displaying the interpolation image data on the image display, the interpolating performing the dither process by using a second dither matrix, where a gray-scale value of the in-bit image data corresponds to a predetermined area, and performing the dither process by using a first dither matrix, where the gray-scale value does not correspond to the predetermined area; and the interpolating performing the dither process by using the second dither matrix only for image data having a predetermined gray-scale value of the in-bit image data.

7. A computer-readable medium containing an image-display program executed by an image-display apparatus that includes an image processing unit and an image display that can display n-bit gray scales, the executed image-display program comprising:

an image-data obtaining program for obtaining m-bit image data to be displayed, all obtained image data being from a same image and having a same resolution;

a bit-number decreasing program for decreasing a number of bits of the image data from m to n, an interpolation program for interpolating a predetermined number of gray scales for the n-bit image data by performing a dither process and generates interpolation image data having a predetermined number of gray scales corresponding to the m bits; and a display control program for displaying the interpolation image data on the image display, the interpolation program performing the dither process by using a second dither matrix, where a gray-scale value of the in-bit image data corresponds to a predetermined area, and performing the dither process by using a first dither matrix, where the gray-scale value does not correspond to the predetermined area; and the interpolation program performing the dither process by using the second dither matrix only for image data having a predetermined gray-scale value of the in-bit image data.

* * * * *